United States Patent [19]

Kennedy et al.

[11] Patent Number: 5,006,090

[45] Date of Patent: Apr. 9, 1991

[54] ULTRA-MINIATURE VEHICLE

[75] Inventors: Melvin R. Kennedy, New York, N.Y.; Joseph J. Lubinski, Canton, Hong Kong

[73] Assignee: Lewis Galoob Toys, Inc., South San Francisco, Calif.

[21] Appl. No.: 479,093

[22] Filed: Feb. 9, 1990

[51] Int. Cl.[5] ..... A63H 29/22

[52] U.S. Cl. ..... 446/462

[58] Field of Search ..... 180/65.1; 446/444, 445, 446/446, 462, 455, 457, 469, 470; 310/40 MM; 104/305

[56] References Cited

U.S. PATENT DOCUMENTS 3,964,206 6/1976 Bernhard ..... 446/249

4,031,661 6/1977 Bernhard ..... 446/251

4,429,488 2/1987 Wessels ..... 446/257

*Primary Examiner*—Charles A. Marmor

*Assistant Examiner*—Richard Camby

*Attorney, Agent, or Firm*—Philip M. Shaw, Jr.

[57] ABSTRACT

An ultra-miniature electrically powered vehicle having an electric motor which drives at least one of the vehicle's wheels, and which is energized through a pair of pick-up shoes contacting an electrified track. The brush assemblies of the motor are located substantially parallel and proximate to the vehicle's front axle and extend outwardly of the vehicle chasis into the volume defined by the front wheels, which are open on the inside face. The drive shaft of the motor lies above the plane defined by the axles of the vehicle. These features enable the vehicle to be significantly smaller than those of the prior art.

4 Claims, 4 Drawing Sheets

ULTRA-MINIATURE VEHICLE

BACKGROUND OF THE INVENTION

1. Technical Field of the Invention

The present invention relates generally to ultra-miniature electrically powered vehicles which, due to the configuration of certain key elements, are constructed smaller and more compactly than other competitive vehicles of this type.

2. Description of the Relevant Art

A toy consisting of a miniature, electrically powered vehicle which is caused to operate on a continuous track enjoys wide popular appeal. The track has at least a pair of electrical rails embedded under its surface which contact a pair of pick-up shoes carried by the vehicle.

FIGS. 2, 4 and 6 represent a typical miniature, electrically powered vehicle of the prior art which is currently in use. Vehicle 20 employing molded plastic body 11 is caused to frictionally fit over and engage chasis 23. In the depicted configuration, electric motor 7, having magnets 32, is directly linked to drive shaft 16. The shaft is terminated by drive pinion 21 which engages crown gear 22 fixed to rear axle 13. Upon energizing motor 7, rear axle 13 is caused to turn which, as a consequence, spins rear wheels 15.

The size of prior miniature, electrically powered vehicle 20 is such that the plane established by drive shaft 16 is substantially coincident with the plane of rear axle 13. As a consequence, drive pinion 21 and crown gear 22 are all that is required to cause rear axle 23 to turn upon the urging of draft shaft 16.

It is intended that vehicles 10, of the present invention, and 20, of the prior art, ride upon tracks 41 and 42, respectively. In doing so, guide pins 25 and 24 extend downward below each chassis and into a slotted track to assist in maintaining the toy vehicles on their respective roadways.

In operation, prior art vehicle 20 employs pick-up shoes 18 extending downward from the bottom of chasis 23 such that each pick-up shoe engages one of the track rails and remains in sliding contact with the rail as the vehicle moves along the track thereby delivering electric power to the vehicle.

As shown in FIG. 6, electric motor 7 mounted in chasis 23 receives electric power through pick-up shoes 18 by delivering the electric power to commutator 33. Electrical contact between pick-up shoes 18 and commutator 33 is done by employing brush assemblies 19 which consist of brush assembly casings for housing springs 37 causing shafts 38 to press against rotating commutator 33 during operation of the vehicle.

As shown here, magnets 32 of electric motor 7 are horizontally opposed and located toward the sides of vehicle 20. The attraction of the magnets to the metal electrical rails embedded in the track 42 helps to keep the vehicle 20 on the track during high speed cornering. In some embodiments of the prior art, such as U.S. Pat. No. 4,429,488, the magnets may be vertically opposed, i.e. oriented toward the top and bottom of the car. The magnet on the bottom becomes more strongly attracted to the track, while the magnet on the top is less strongly attracted, but the result is a net increase of the attraction of the magnets to the track, helping further to hold the car to the track during cornering.

The fact that brush assemblies 19 are placed forward of motor 7 and completely within chasis 23, and the coincidence of the planes of drive shaft 16 and rear axle 13, requires that vehicle 20 be of a certain minimum size to allow for such placement.

To reduce the size of the vehicle, it has been found that it is not feasible to locate these elements in their prior-art configuration. Specifically, significant reduction in length requires that the drive shaft and wheel axles not remain in coincident planes. Thus, the use of only a drive pinion and spur gear as used by the prior art is not feasible in reducing the size of the vehicle as contemplated herein.

Also, the placement of the brush assemblies are placed forward of the motor and completely within the chasis similarly limits the minimum length of the vehicle.

SUMMARY OF THE INVENTION

To allow a smaller vehicle to be constructed, the present invention comprises a miniature electrically powered vehicle having front and rear axles supported by a vehicle chasis and an electric motor operatively connected to at least one drive wheel of the vehicle, the motor being energized through a pair of pick-up shoes which engage a track having electric power means contained therein. The electric motor rotates a drive shaft extending axially along the length of said vehicle which lies in a plane which is not coincident with the plane of the rear axle. The pick-up shoes are attached to brush assemblies which are, in turn, connected to a commutator of said electric motor for energizing said electric motor, with the brush assembly casings being located substantially perpendicular to the vehicle chasis, but proximate and substantially parallel to the front axle and extending outwardly of the vehicle chasis into the volume defined by the front wheels.

By locating the brush assemblies this way, and by allowing the drive shaft to overlap the rear axle, an ultra-miniature, electrically powered toy vehicle which is significantly smaller than those of the prior art can be constructed.

It is thus an object of the present invention to provide an ultra-miniature toy vehicle capable of riding upon an electrified track which is similar to the significantly larger vehicles of the prior art.

The features and advantages described in the specification are not all inclusive, and many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

DETAILED DESCRIPTION OF THE PREFERRED EMBODIMENT

FIGS. 1, 3, 5 and 7 through 10 of the drawings depict various preferred embodiments of the present invention for purposes of illustration only. One skilled in the art will readily recognize from the following discussion that alternative embodiments of the structures and methods illustrated herein may be employed without departing from the principles of the invention described herein.

Figure 1:
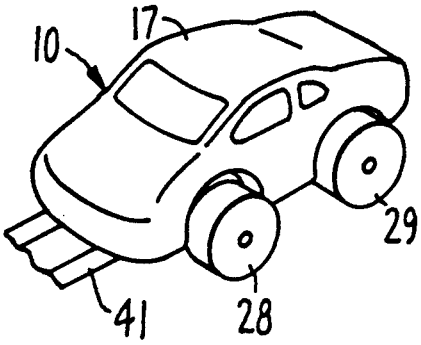
FIG. 1 represents a perspective view of the exterior of the vehicle of the present invention.
Figure 2:
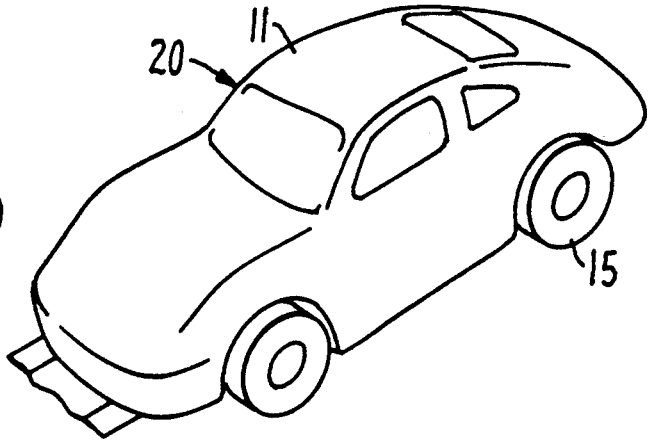
(PRIOR ART) FIG. 2.
FIG. 2 represents a perspective view of the exterior of a vehicle of the prior art.
Figure 3:
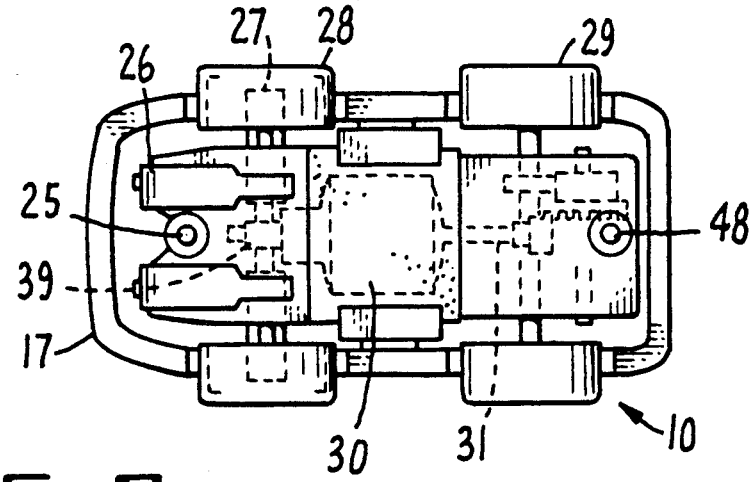
FIG. 3 is a bottom plan view of the vehicle of the present invention.

FIG. 1 shows vehicle 10 of the present invention, having molded plastic body 17 frictionally mounted upon it, riding upon track 41. As seen in FIG. 3, guide pin 25 extends downward below vehicle 10 into the slotted track. Electric motor 30 receives electric power through pick-up shoes 26, each of which engages one of the guide rails and remains in sliding contact with the rail as the vehicle moves along the track, as in the prior art.

The power received by pick-up shoes 26 is delivered to commutator 39 by brush assemblies 27, which consist of brush assembly casings housing springs 45 which cause shafts 40 to press against rotating commutator 39 during operation.

Figure 5:
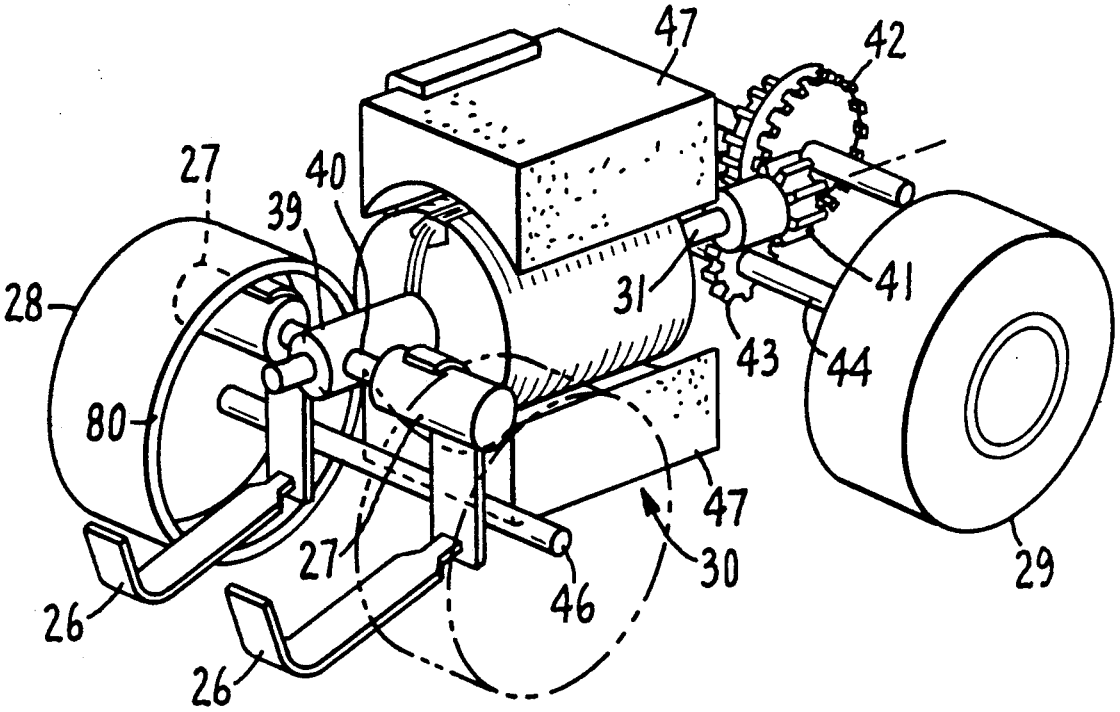
FIG. 5 is a perspective view of the vehicle of the present invention showing the motor, drive train and electrical pick-up means.

FIG. 5 illustrates the major components of vehicle 10. Electric motor 30 having magnets 47 is linked to drive shaft 31, which terminates in pinion gear 41 above rear axle 44. Pinion gear 41 in turn engages the side of spur gear 42 which is closest to the centerline of vehicle 10, crown gear 42 having two sides which each have a set of teeth. The other side of spur gear 42 in turn engages spur gear 43 which is mounted on rear axle 44.

The use of three gears, rather than two as in the prior art, allows the pinion gear and the rear axle to be in different planes. This in turn allows the pinion gear to overlap the rear axle, reducing the minimum size of the vehicle substantially. In addition, spur gear 42 can be removed from the vehicle and replaced with a spur gear of different dimension to change the speed of rotation of the rear axle.

The other major reduction in size of the vehicle 10 of the present invention is obtained by relocating the brush assemblies 27. As above, in the prior art, the brush assemblies are located behind the front axle and front wheels. However, in the present invention, the front wheels are hollow and open on the side facing the chassis, i.e. the inside face of the wheel. Brush assemblies 27 extend into the open side of the wheels, and the wheels rotate around them. Since brush assemblies 27 are contained within front wheels 28 instead of being located behind them, again the vehicle 10 can be significantly shorter than vehicles of the prior art.

Figure 4:
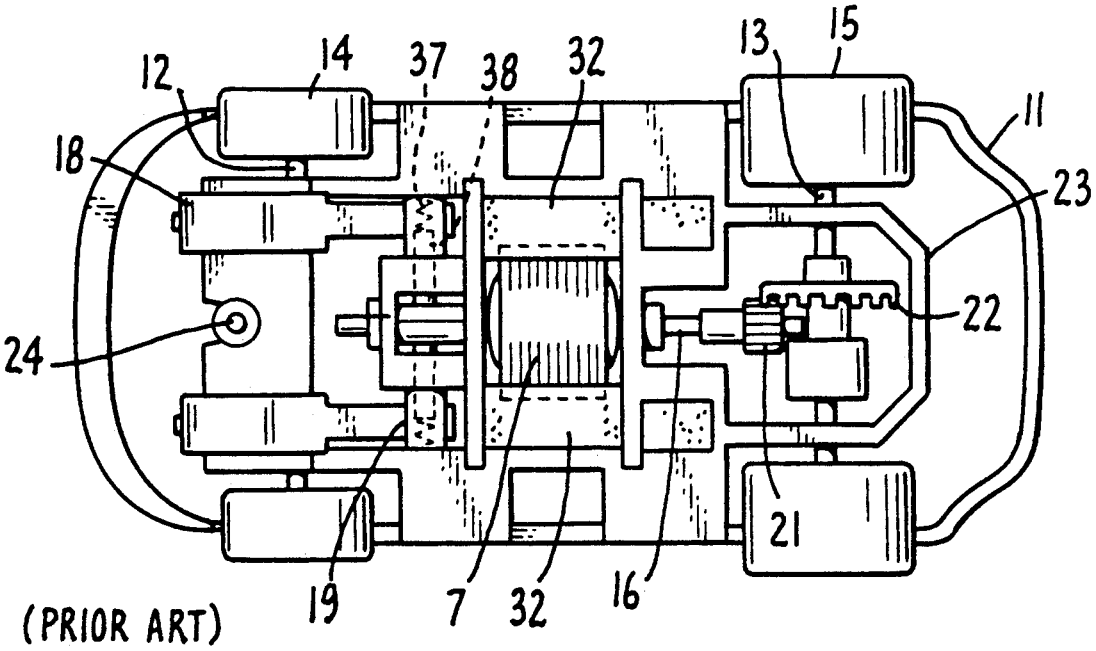
(PRIOR ART) FIG. 4.
FIG. 4 is a bottom plan view of a vehicle of the prior art.
Figure 6:
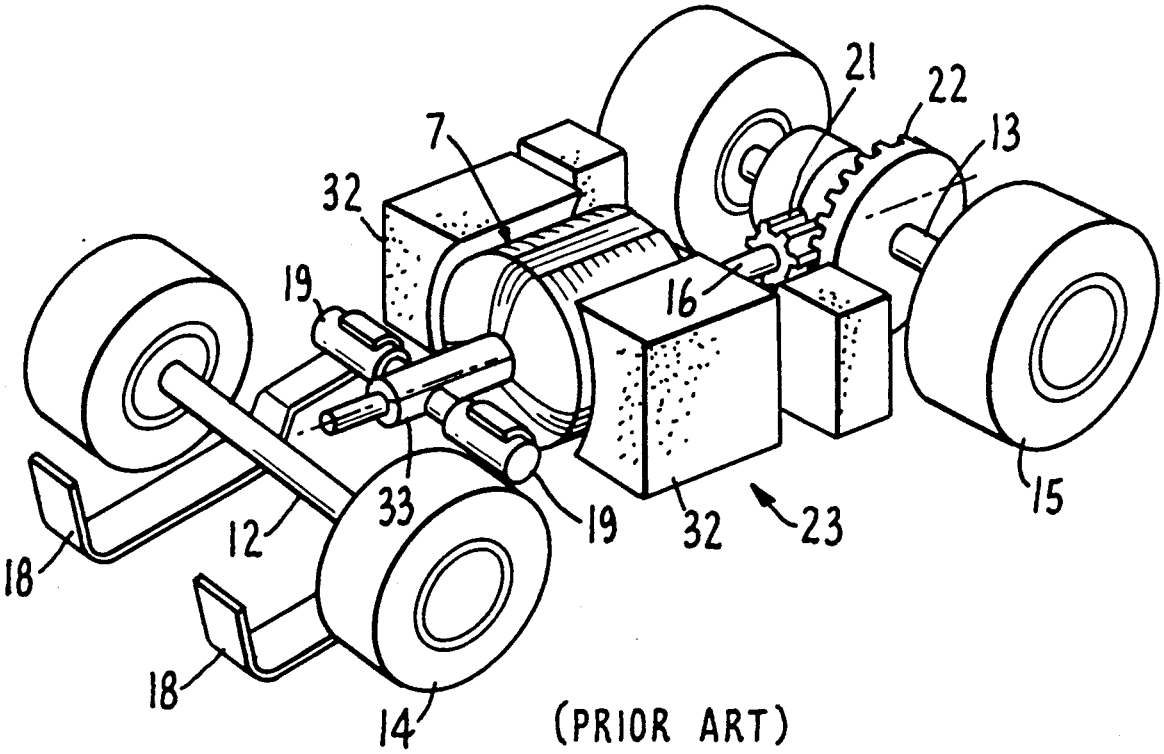
(PRIOR ART) FIG. 6.
FIG. 6 is a perspective view of a vehicle of the prior art showing the motor, drive train and electrical pick-up means.
Figure 7:
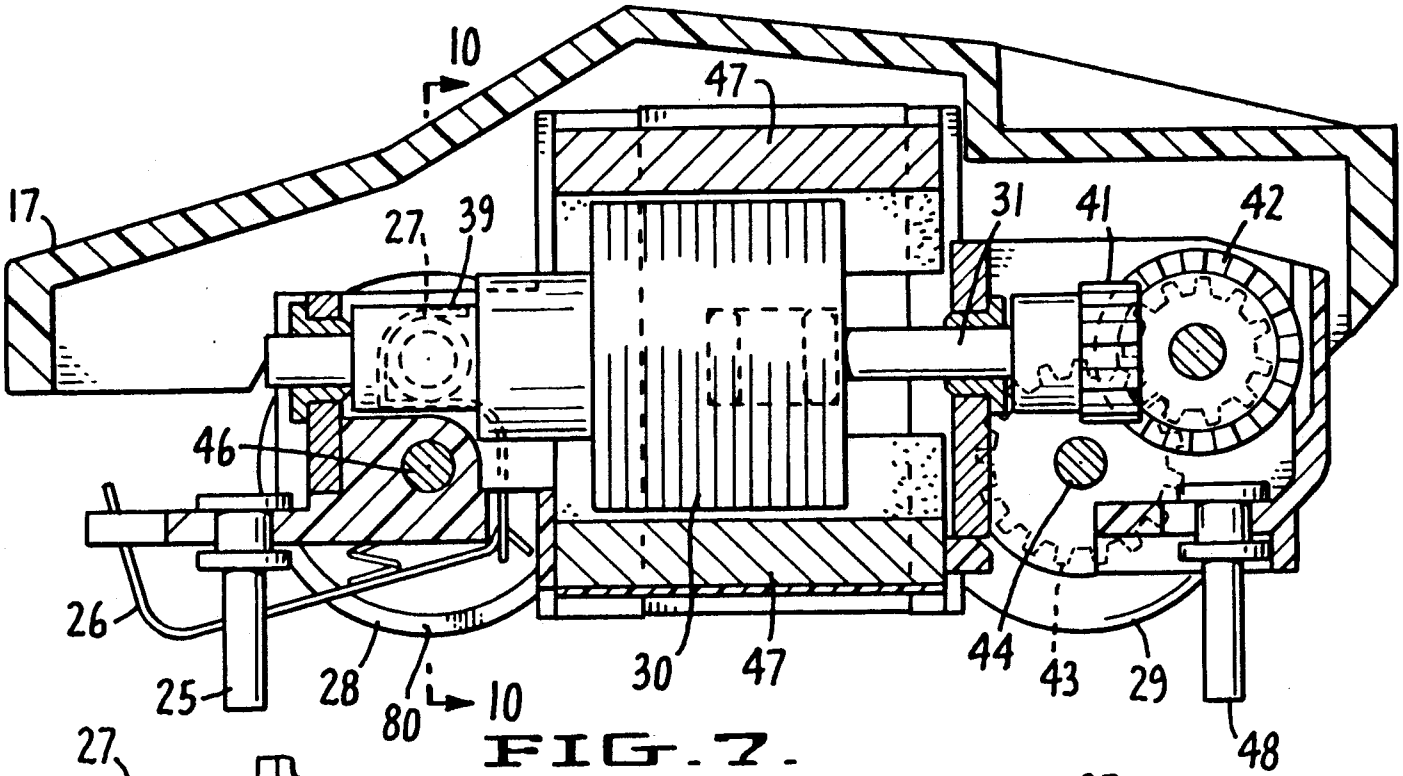
FIG. 7 is a cross-sectional side view of the vehicle of the present invention.

By comparing FIG. 7 to the prior art it can easily be seen how in the present invention drive shaft 31 and pinion gear 41 lie in a plane above rear axle 44, and how the vehicle 10 can thus be shortened by the use of the three gears. In the prior art, as shown in FIGS. 4 and 6, all of pinion gear 21 must be located in front of rear axle 13, while in FIG. 7 pinion gear 41 extends well behind rear axle 44.

Figure 8:
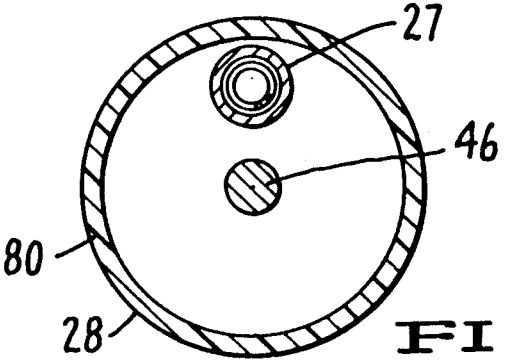
FIG. 8 is a detailed cross-sectional view of the front axle, wheel and pick-up assembly of the vehicle of the present invention.
Figure 9:
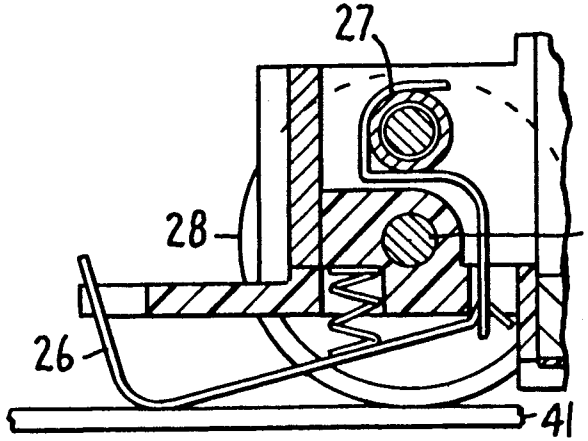
FIG. 9 is a cross-sectional view showing only the front wheel, axle and brush assembly of the vehicle of the present invention.
Figure 10:
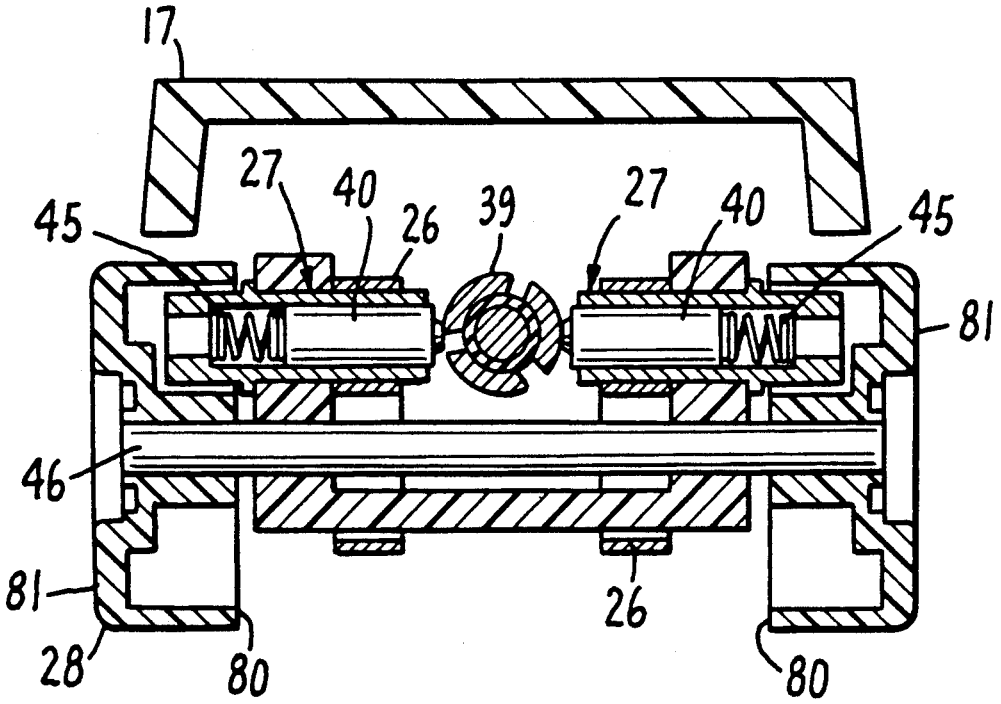
FIG. 10 is a cross-sectional view taken along line 10—10 of FIG. 7.

FIGS. 7, 8 and 9 all show varying side views which include the configuration of the brush assembly 27 and the front wheels 28. As shown in each figure, the brush assembly is located between the wheels, rather than behind the wheels as in the prior art. Again, a comparison with FIGS. 4 and 6, in which brush assemblies 19 are behind front wheels 14 shows how this feature of the present invention also allows for significant shortening of the vehicle 10.

FIG. 9 is a cross-sectional view of the vehicle 10, clearly showing how the brush assemblies 27 fit within the hollow portion of front wheels 28. The front wheels 28 are provided with circumferential surfaces 80 for contact with the track and web portion 81 for enclosing the circumferential surfaces. Again, front wheels 28 rotate around the brush assemblies 27. As with the previous figures, FIG. 10 also shows that like drive shaft 31, brush assemblies 27 lie above front axle 46.

It may also be seen that, as a result of this construction, vehicle 10 is not only shorter than a vehicle of the prior art, but also has a higher center of gravity. This results in an increased tendency of the vehicle to go off the track when cornering. For this reason, it is preferable if the magnets 47 are opposed vertically rather than horizontally since, as described above, this results in increased attraction of the magnets to the track and thus helps keep the vehicle on the track. In addition, a rear guide pin 48 can be added at the rear of the vehicle 10, as seen in FIG. 7. This also assists in keeping the vehicle on the track during cornering. Ideally, the rear guide pin 48 is removable, so that when the pin is in place the vehicle remains on the track at higher speeds and is easier to drive, but can be removed to create a greater challenge as the driver attains more skill. More experienced drivers can even use the outward slide of the rear of the car on curves to knock the opponent's car off the track if the rear guide pin is removed.

From the above description, it will be apparent that the invention disclosed herein provides a novel and advantageous apparatus for constructing an ultraminiature electrically powered vehicle for operation on a slotted track containing electrical means for supplying power to the vehicles. The foregoing discussion discloses and describes merely exemplary methods and embodiments of the present invention. As will be understood by those familiar with the art, the invention may be embodied in other specific forms without departing from the spirit or essential characteristics thereof. For example, it may be possible to position the magnets of the motor so that they are opposed horizontally rather than vertically and still obtain sufficient attraction between the magnets and the track to adequately keep the vehicle on the track. Accordingly, the disclosure of the present invention is intended to be illustrative, but not limiting, of the scope of the invention, which is set forth in the following claims.

We claim:

1. A miniature electrically powered vehicle having a front axle and rear axle supported by a vehicle chassis, said front axle supporting front wheels each being characterized as having a circumferential surface for contact with a track and a web portion for enclosing said circumferential surface and for supporting said front wheels on said front axis such that said front wheels are substantially hollow and open to said vehicle chassis, said vehicle having an electric motor operatively connected to at least one drive wheel of the vehicle, the electric motor being energized through a pair of pick-up shoes which engage the track, the track including electric power means contained therein, said electric motor being mounted in the vehicle chassis such that said brush assembly casings extend into the hollow portions of said front wheels for rotating a drive shaft extending axially along the length of said vehicle, said pick-up shoes being attached to brush assemblies which are, in turn, connected to a commutator of said electric motor for energizing said electric motor, said brush assemblies including brush assembly casings for housing springs and shafts, said springs urging said shafts against said commutator, said brush assembly casings being located substantially perpendicular to the vehicle chasis and substantially parallel and proximate to said front axle and extending outwardly of said vehicle chasis.

2. The miniature electrically powered vehicle of claim 1 wherein the electric motor is located within and supported by said vehicle chasis such that said drive shaft is located vertically above a plane defined by said front and rear axles.

3. The miniature electrically powered vehicle of claim 2 wherein said drive shaft supports a drive pinion which is in meshing engagement with a driven spur gear which, in turn, engages a toothed gear supported by said rear axle for rotating said rear axle upon rotation of the drive shaft by said electric motor.

4. The miniature electrically powered vehicle of claim 3 wherein said spur gear can be removed from said vehicle chasis and replaced with a spur gear of differing dimension to change the speed of rotation of the rear axle while maintaining a uniform motor speed.

* * * * *